US011464261B2

(12) United States Patent
Der Hoeven

(10) Patent No.: US 11,464,261 B2
(45) Date of Patent: Oct. 11, 2022

(54) BRASSIERE INCLUDING A FOAM SUPPORT FOR THE BREASTS

(71) Applicant: HANES OPERATIONS EUROPE SAS, Rueil Malmaison (FR)

(72) Inventor: Manon Turlan-Van Der Hoeven, Marmagne (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 184 days.

(21) Appl. No.: 15/535,678

(22) PCT Filed: Dec. 18, 2015

(86) PCT No.: PCT/IB2015/059800

§ 371 (c)(1),
(2) Date: Jun. 13, 2017

(87) PCT Pub. No.: WO2016/103135

PCT Pub. Date: Jun. 30, 2016

(65) Prior Publication Data

US 2017/0340022 A1 Nov. 30, 2017

(30) Foreign Application Priority Data

Dec. 23, 2014 (FR) ..... 1463248

(51) Int. Cl.
*A41C 3/00* (2006.01)
*A41C 3/12* (2006.01)

(52) U.S. Cl.
CPC ..... *A41C 3/0007* (2013.01); *A41C 3/12* (2013.01)

(58) Field of Classification Search
CPC ..... A41C 3/0007; A41C 3/12; A41C 3/007; A41C 1/14; A41C 1/16; A41C 1/20
(Continued)

(56) References Cited

U.S. PATENT DOCUMENTS 2,524,620 A * 10/1950 Cadous ..... A41C 3/06 450/41
2,524,621 A * 10/1950 Cadous ..... A41C 3/06 450/41

(Continued)

FOREIGN PATENT DOCUMENTS

CN 1557236 12/2004
CN 1741755 3/2006

(Continued)

OTHER PUBLICATIONS

Korean Office Action in Korean Application No. 10-2017-7019871, dated Apr. 1, 2019, 12 pages.

(Continued)

*Primary Examiner* — Alissa J Tompkins
*Assistant Examiner* — Catherine M Ferreira
(74) *Attorney, Agent, or Firm* — Fish & Richardson P.C.

(57) ABSTRACT

A brassiere (1) with at least one underwire designed to be disposed at least at the lower join zone between each breast and the trunk of a user, the brassiere (1) including two cups (2, 3) designed to cover the breasts at least in part and onto which the underwire is fastened, characterized in that it includes at least one basque (e.g., cradle), (4) disposed on brassiere (1), so as to there-with cover at least the underwiring, and designed to be interposed between at least the underwiring and the body of the user.

18 Claims, 1 Drawing Sheet

(58) Field of Classification Search
USPC ..... 450/41; 2/255, 256, 257, 258, 260, 261
See application file for complete search history.

(56) References Cited

U.S. PATENT DOCUMENTS

| | | | | |
|---|---|---|---|---|
| 7,131,888 | B2 * | 11/2006 | Hsu | A41C 3/0007 450/39 |
| 8,113,908 | B1 | 2/2012 | Modena et al. | |
| 2002/0022432 | A1 * | 2/2002 | Magrone | A41C 3/0014 450/41 |
| 2003/0232571 | A1 * | 12/2003 | Weinerth | A41C 3/10 450/41 |
| 2006/0046614 | A1 * | 3/2006 | Hsu | A41C 3/0007 450/1 |
| 2006/0223415 | A1 | 10/2006 | Watrin et al. | |
| 2008/0090491 | A1 * | 4/2008 | Liu | A41C 3/0014 450/39 |
| 2010/0317256 | A1 * | 12/2010 | Zhang | A41C 5/005 450/38 |
| 2013/0065485 | A1 * | 3/2013 | Goodwin | A41C 3/10 450/41 |

FOREIGN PATENT DOCUMENTS

| | | | |
|---|---|---|---|
| CN | 200987367 | | 12/2007 |
| CN | 201430928 | | 3/2010 |
| CN | 101999758 | | 4/2011 |
| CN | 201781995 | | 4/2011 |
| CN | 202035490 | | 11/2011 |
| CN | 104000310 | | 8/2014 |
| CN | 203762309 | | 8/2014 |
| CN | 203841141 | | 9/2014 |
| CN | 205093600 | | 3/2016 |
| FR | 2850536 | A1 | 8/2004 |
| FR | 2890832 | A1 | 3/2007 |
| FR | 2906111 | A1 | 3/2008 |
| FR | 2908270 | A1 | 5/2008 |
| FR | 2972905 | A1 | 9/2012 |
| KR | 2003068122 | A | 8/2003 |
| WO | WO0207548 | A1 | 1/2002 |
| WO | WO2006110387 | A2 | 10/2006 |
| WO | WO2008037862 | A3 | 4/2008 |
| WO | WO2013136011 | A2 | 9/2013 |

OTHER PUBLICATIONS

Chinese Second Office Action in Chinese Application No. 2015800703315, dated Feb. 25, 2019, 16 pages.
European Office Action in European Application No. 15817577, dated Mar. 15, 2019, 5 pages.
PCT International Search Report and Written Opinion of the International Searching Authority, PCT/IB2015/059800, dated Feb. 23, 2016, 13 pages.
PCT International Preliminary Reporton Patentability, PCT/IB2015/059800, dated Jan. 16, 2017, 11 pages.
Australian Examination Report in Australian Application No. 2015370504, dated Mar. 22, 2018, 2 pages.
Canadian Office Action in Canadian Application No. 2972181, dated Apr. 23, 2018, 3 pages.
Chinese First Office Action in Chinese Application No. 2015800703315, dated Apr. 16, 2018, 15 pages.
Korean Office Action in Korean Application No. 10-2017-7019871, dated Jun. 25, 2018, 9 pages.
New Zealand Office Action in New Zealand Application No. 732722, dated Dec. 6, 2017, 3 pages.
Chinese Third Office Action in Chinese Application No. 201580070331.5, dated Aug. 9, 2019, 22 pages with English Translation.

* cited by examiner

BRASSIERE INCLUDING A FOAM SUPPORT FOR THE BREASTS

TECHNICAL FIELD

The present disclosure is in the domain of articles of lingerie and more particularly the domain of brassieres.

BACKGROUND

Traditionally, brassieres can be classified in two principal categories, one grouping brassieres without underwiring, designed for women exhibiting small breasts and the other grouping brassieres with underwiring, designed for women exhibiting medium-sized or large breasts.

Brassieres without underwiring exhibit a construction including a textile cut out and sewn or molded in order to make the cups of the brassiere. These cups are then fastened to straps and to a support band.

Brassieres with underwiring offer improved support for the breasts. These brassieres customarily include sewn or molded cups to which are attached elements serving as underwiring, such as ribs. Normally, these ribs are made up of a relatively rigid material, such as a metal rod or possibly a rigid element in a synthetic material. The ribs are then sewn to the interior of a structure made of a woven fabric in order to protect them, particularly when washing, and to protect the person who wears that type of brassiere.

Such brassieres with underwiring exhibit drawbacks, particularly in that there is always a risk of the user being injured due to poor positioning of the ribs. On the one hand, although improving the support of the breasts, the underwires cause feelings of discomfort when the brassiere is worn, particularly due to the fact that the materials used to fabricate the underwires are rigid materials, which press on the skin and do not truly adjust to the morphology of a body which is moving. On the other hand, the underwires rest on the bones and, in the case of strenuous activity on the part of the user, can cause the formation of blisters or can tear the skin underneath the breasts.

SUMMARY

The present disclosure aims to propose a brassiere, particularly one free of the afore-mentioned drawbacks, and for this it proposes a brassiere with at least one underwire designed to be disposed at least in the zone of the lower join between each breast and the trunk of a user, the brassiere including two cups designed to cover the breasts at least in part and whereon the underwiring is fastened, distinguished in that it includes at least one basque (e.g., cradle), disposed on the brassiere, so as to therewith cover at least the underwiring, and designed to be interposed between at least the underwiring and the body of the user.

The "lower" join zone is understood to be the join zone located farthest from the head of the user (closest to the pelvis), stretching roughly in at least a semi-circle.

In this way, the basque allows compression to be reduced, particularly of the underwiring against the skin and the bones of the user, reducing or eliminating the drawbacks caused by the underwiring when using the brassiere according to the disclosure, particularly in the case of strenuous activity on the part of the user which causes numerous relative movements between the brassiere according to the disclosure and the body of the user.

The brassiere according to the disclosure can include one or several of the following optional characteristics:

the basque extends at least in part from the underwiring to the interior of the cups;

the basque is executed of an assemblage comprising a textile and a foam; impacts between the underwiring and the trunk of the user are thus absorbed well by the basque;

the basque is fabricated of polyurethane foam;

the basque is fabricated of ethylene vinyl acetate;

the basque is padded, particularly so the breasts are not in homogenous contact with the basque, which in particular allows the skin of the user to breathe better;

the basque is padded so as to exhibit a plurality of small pads;

the basque includes at least one aperture, so as to increase breathability;

the aperture is disposed between the pads in such a way that the skin of the user does not come into direct contact with the wall or walls of the apertures and obstructing them so that they would prevent the apertures from fulfilling their role;

the foam is thermoformed and/or compressed or injected;

the underwiring may be understood to be fastened directly or indirectly onto the cups;

the basque includes at least one strip designed to receive the underwiring by means of its insertion;

the basque is heat-sealed onto the brassiere using a film or dots of glue;

the basque is sewn onto the brassiere;

the basque is made in one piece or as one piece made from several assembly pieces;

the basque extends over the entire length of the underwiring so as to form a piece in the shape of an omega (ω);

the tips of the ω each exhibit at least one pad with dimensions greater than the other pads of the padding.

The disclosure also concerns a method of fabricating a basque according to the disclosure and a method of fabricating a brassiere according to the disclosure.

The fabrication method for the basque is distinguished in that it includes a step of thermoforming two layers of foam, between which other foam elements are disposed, such that as a result of the thermoforming, the basque exhibits an uneven surface, for example by exhibiting bumps in the form of pads.

On the other hand, the fabrication method for the basque can include a step of cutting through the thermoformed foam, preferably at sites where the thickness of the basque is the smallest possible when the surface of the basque is uneven.

The method of fabricating the brassiere is distinguished in that it includes a step of fastening the basque onto the brassiere, so as to therewith cover at least the underwires, and designed to be interposed between the underwires and the body of the user.

The fabrication method for the brassiere can also include a step to position the basque so that it extends at least in part toward the interior of the brassiere cups.

The fabrication method for the brassiere can include a step to insert underwires into a basque inside strips provided for this purpose, according to one embodiment of the disclosure.

BRIEF DESCRIPTION OF THE DRAWINGS

Several embodiments of the present disclosure are now described by way of non-limiting examples, referring to the attached figures. Identical or analogous references in the set of figures designate identical or analogous parts or assemblies of parts.

DETAILED DESCRIPTION

Figure 1:
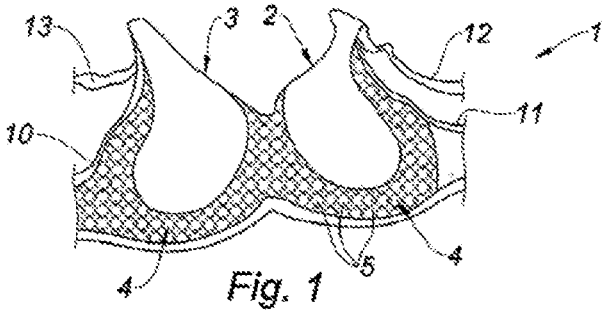
FIG. 1 represents a brassiere according to one embodiment of the present disclosure.

Referring to FIG. 1, a brassiere 1 is described according to one embodiment of the present disclosure.

The brassiere 1 is a brassiere 1 with two underwires (not depicted) designed to be disposed in the lower join zone between each breast and the trunk of a user, brassiere 1 including two cups 2 and 3 designed to cover the breasts at least in part and onto which the underwires are fastened.

Brassiere 1 also includes a one-piece basque 4 disposed on brassiere 1, so as to therewith cover the underwires, and designed to be interposed between the underwires and the body of the user.

Basque 4 extends predominantly from the underwiring to the interior of cups 2 and 3 and is made from an assembly comprising a textile and thermoformed polyurethane so as to exhibit padding in the form of small pads 5.

It should be observed that since basque 4 is added onto brassiere 1 in a fitted manner, such a basque can be advantageously added onto any existing brassiere so as to be removable or not.

Figure 2:
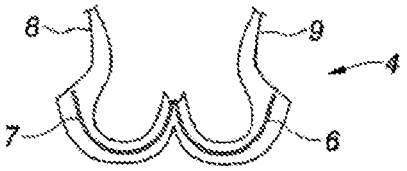
FIG. 2 represents a basque according to a first embodiment of the present disclosure.

Referring to FIG. 2, a basque 4 according to a first embodiment of the disclosure is described.

Basque 4 exhibits an omega (ω) shape and includes strips 6 and 7, that is, tunnels into which the underwires can be inserted which are designed to be fastened onto the brassiere.

Optionally, the ends 8 and 9 of basque 4 extend the length of the external sides 10 and 11 (FIG. 1) of cups 2 and 3 and thus can go up to the straps 12 and 13, represented in FIG. 1, of brassiere 1.

Figure 3:
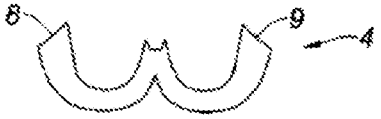
FIG. 3 represents a basque according to a second embodiment of the present disclosure.

Referring to FIG. 3, a basque 4 is described according to a second embodiment of the present disclosure.

Ends 8 and 9 of basque 4 do not go along the external sides 10 and 11 of cups 2 and 3, and basque 4 therefore extends to the external sides 10 and 11 as far as the ends of the underwires.

Figure 4:
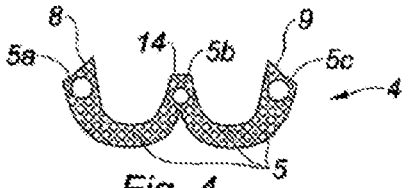
FIG. 4 represents a basque according to a third embodiment of the present disclosure.

Referring to FIG. 4, a basque 4 is described according to a third embodiment of the present disclosure.

Basque 4 is padded so as to exhibit small pads 5 shaped as portions of spheres, some of which, 5a, 5b, 5c, preferably located at ends (points) 8 and 9 and at the central point 14, exhibit dimensions greater than the others. Of course, other pads 5 with dimensions greater than the others can be disposed at several other locations on the basque 4.

Figure 5:
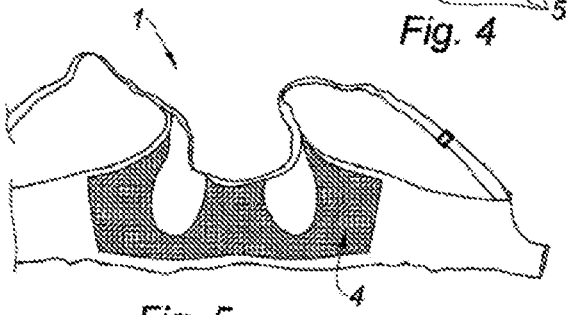
FIG. 5 represents a basque according to a fourth embodiment of the present disclosure.

Referring to FIG. 5, a basque 4 is described according to a fourth embodiment of the present disclosure.

In this embodiment, basque 4 exhibits generous surfaces to cover all sizes and shapes of underwiring and all shapes of brassiere.

Figure 6:
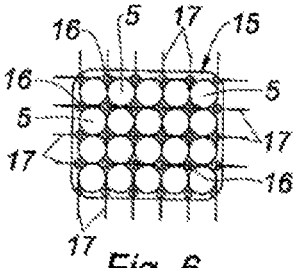
FIG. 6 represents a detail of the padding of a basque according to the disclosure, according to one embodiment of the present disclosure.

Referring to FIG. 6, a detail of the padding 15 of a basque 4 is described, for example that of FIG. 1, according to an embodiment of the present disclosure.

The padding 15 exhibits a plurality of small pads 5, each exhibiting the shape of a portion of a sphere, the disclosure not being limited to such a geometry and thus possibly also involve, for example, a geometric network of straight lines fabricated according to a method similar to that for the network of pads 5.

Said pads 5 are fitted on the squares of a checkerboard 17, and a plurality of apertures 16 is employed at each junction of two straight lines of the checkerboard 17 thus defined.

It goes without saying that the disclosure is not limited to the embodiments described hereinabove by way of examples, but it can include any technical equivalent or variant of the methods described above, as well as their possible combinations.

The invention claimed is:

1. A brassiere with at least one underwire configured to be disposed at least at a lower join zone between each breast and a trunk of a user, the brassiere including:

two cups configured to cover the breasts of the user at least in part and including the at least one underwire fastened to the brassiere;

wherein the brassiere includes at least one basque disposed on the brassiere to cover the at least one underwire, the basque configured to be interposed between the at least one underwire and a body of the user, wherein the basque is padded and includes a plurality of small pads on a first surface of the basque, the basque extends over an entire length of the at least one underwire and has an omega shape such that the plurality of small pads are provided over the entire length of the at least one underwire, tips of the omega shape of the basque each include a larger pad of the plurality of small pads, wherein each of the larger pads at the tips of the omega shape is surrounded by other pads of the plurality of small pads, and each of the larger pads at the tips of the omega shape of the basque has planar dimensions on the first surface of the basque that are greater than the other pads of the plurality of small pads.

2. The brassiere according to claim 1, wherein the basque extends at least in part from the at least one underwire to an interior of the cups.

3. The brassiere according to claim 1, wherein the basque comprises a textile and a foam.

4. The brassiere according to claim 1, wherein each pad in the plurality of small pads includes a shape of a portion of a sphere.

5. The brassiere according to claim 1, wherein the basque includes at least one aperture.

6. The brassiere according to claim 5, wherein the at least one aperture is disposed between pads of the plurality of small pads.

7. The brassiere according to claim 1, wherein the basque includes at least one strip configured to receive the at least one underwire by insertion of the at least one underwire into the strip.

8. The brassiere according to claim 3, wherein the foam comprises a polyurethane foam.

9. The brassiere according to claim 1, wherein the basque comprises ethylene vinyl acetate.

10. The brassiere according to claim 1, wherein ends of the basque extend a length of external sides of the cups.

11. The brassiere according to claim 1, wherein the basque extends to external sides of the cups as far as the ends of the at least one underwire.

12. The brassiere according to claim 1, wherein the basque is heat-sealed to the brassiere with a film or dots of glue.

13. The brassiere according to claim 1, wherein the basque is sewn to the brassiere.

14. The brassiere according to claim 6, wherein the plurality of small pads are fitted onto squares of a checkerboard pattern of the basque, and a plurality of apertures including the at least one aperture are positioned at each junction of two straight lines of the checkerboard pattern.

15. The brassiere according to claim 1, wherein the basque is padded such that the plurality of small pads is disposed on the basque and not disposed on a remainder of the brassiere.

16. The brassiere according to claim 1, wherein the plurality of small pads are disposed on the first surface of the basque and are configured toward the breasts of the user so that the basque is not in homogenous contact with the breasts of the user.

17. The brassiere according to claim 1, wherein the basque is configured to extend from a first underarm of the user to a second, opposite underarm of the user.

18. The brassiere according to claim 1, wherein the planar dimensions include a longitudinal dimension on the first surface of the basque and a lateral dimension on the first surface of the basque.

* * * * *